United States Patent [19]

Suematsu et al.

[11] Patent Number: 4,666,814

[45] Date of Patent: May 19, 1987

[54] METHOD FOR DEVELOPING ELECTROSTATIC LATENT IMAGE WITH NON-MAGNETIC TONER

[75] Inventors: Koshi Suematsu, Kawasaki; Masanori Takenouchi, Urawa; Motoo Urawa, Funabashi; Takeshi Ikeda, Yokohama, all of Japan

[73] Assignee: Canon Kabushiki Kaisha, Tokyo, Japan

[21] Appl. No.: 658,510

[22] Filed: Oct. 9, 1984

[30] Foreign Application Priority Data

Oct. 19, 1983 [JP] Japan ..... 58-195611

[51] Int. Cl.[4] ..... G03G 13/14

[52] U.S. Cl. ..... 430/126

[58] Field of Search ..... 430/120, 122, 126; 118/653, 657, 658

[56] References Cited

U.S. PATENT DOCUMENTS 4,297,384 10/1981 Kudo et al. ..... 430/103

4,444,864 4/1984 Takahashi ..... 430/120

*Primary Examiner*—John L. Goodrow

*Attorney, Agent, or Firm*—Fitzpatrick, Cella, Harper & Scinto

[57] ABSTRACT

A method for developing electrostatic latent images formed on an electrostatic image bearing member, particularly by a thin and uniform layer of toner formed on a toner carrying member. In the method, good images can be stably obtained by controlling the packing density within the range of 0.1 to 0.6 g/cm$^3$ with respect to the toner layer carried on the toner carrying member at the developing station.

8 Claims, 6 Drawing Figures

METHOD FOR DEVELOPING ELECTROSTATIC LATENT IMAGE WITH NON-MAGNETIC TONER

BACKGROUND OF THE INVENTION

This invention relates to a method for developing electrostatic latent images formed on an electrostatic image-bearing member, particularly to a method for development by forming a thin and uniform toner layer on a toner carrying member.

In the prior art, the following methods have been known as methods for carrying out development by use of a substantially non-magnetic one-component toner, i.e., a non-magnetic or weakly magnetic toner.

For example, there is known a method for developing electrostatic images comprising causing a developer-carrying member carrying a developer on the surface thereof to face a latent image-bearing member, and developing a latent image on the latent image-bearing member, wherein the developer accumulated in a developer-storing means below the developer-carrying member is drawn up onto the developer carrying member while giving vibration to the developer only at the drawing-up position to activate the developer and caused to form a developer layer to a desired thickness on the developer carrying member, which developer layer is then supplied for development.

Another method comprises providing a rotatable magnetic roller for forming a magnetic brush by attracting magnetic carriers for charging one-component toner particles and a developing roller for developing electrostatic latent images on an electrostatic latent image-bearing member by transfer of the toner particles onto the roller, and developing the electrostatic images, while maintaining a gap between the electrostatic image-bearing member and the developing roller at the developing station, with the gap being set greater than the thickness of the coated toner layer on the developing roller.

Still another method comprises providing a movable developer-carrying means which carries, conveys and feeds a developer to a latent image (electrostatic image)-bearing member, a developer-feeding means and a movable coating means which receives feed of the developer from the developer-means and applies the developer to the above movable developer-carrying means, said movable coating means having a fiber brush for carrying the developer on its surface and contacting the above movable developer-carrying means to apply the toner uniformly to the above movable developer-carrying means at the contacted portion, while moving at higher speed in the same direction as the movable developer-carrying means than the movable developer-carrying means, and approaching the coated layer to the electrostatic latent image portion.

In these methods, compared with a conventional developing method using a one-component toner, a stronger force is applied when a toner is applied onto a toner carrying member, whereby the triboelectric charge imparted to the toner is liable to become higher and to increase with the continuation of developing operation. Thus, a difficulty is encountered that the image density of the resultant copies varies with the elapse of time and the quality of the copies cannot be maintained constant.

Furthermore, in these methods, a substantially non-magnetic insulating toner is carried on a carrying member at the developing station mainly through a non-magnetic force and used for development. Thus, the force for carrying the toner on the toner carrying member around the developing station consists predominantly of an electrostatic attracting force and a physical attaching force and, in this respect, several difficulties are encountered when compared with a conventional developing method using an insulating magnetic toner where the toner is carried on a carrying member through a magnetic force, an electrostatic force, etc. For example, most toners cannot be applied onto the carrying member to form a relatively thin uniform layer. Further, even if relatively uniformly applied, a phenomenon of so-called fogging occurs where the toner is attached to non-image portions. Further, even if applied to form a thin and uniform layer, the amount of toner attached onto image portions is insufficient to result in images of low densities. Moreover, most toners can produce poor images of low fidelity and low resolution. Most toners can cause decrease in image density or a low quality of image on repeated use. Furthermore, most toners are accompanied with such defects as decrease in image density at one time and fogging at another time, when encountered with changes in environmental conditions including high temperature and high humidity conditions and low temperature and low humidity conditions.

On the other hand, the developing method using a one-component magnetic developer is not only expensive but also is encountered with difficulty in giving beautiful chromatic images, because a large proportion of magnetic material is contained in the magnetic toner particles, compared with non-magnetic or weakly magnetic toner particles.

SUMMARY OF THE INVENTION

A principal object of the present invention is to provide a novel developing method having obviated the above difficulties wherein an insulating, substantially non-magnetic toner is used.

A more specific object of the present invention is to provide a developing method using an insulating non-magnetic toner and giving images with high fidelity and stable image quality.

Another object of the present invention is to provide a developing method using an insulating non-magnetic toner and obviating fogging while giving uniform and sufficiently dense images with a high resolution.

A further object of the present invention is to provide a developing method excellent in durability such as performance in continuous use, wherein an insulating non-magnetic toner is used.

A still further object of the present invention is to provide a developing method which is stable in performance under a variety of environmental conditions including high temperature-high humidity and low temperature-low humidity.

A still another object of the present invention is to provide a developing method capable of giving clear chromatic images.

The developing method of the present invention comprises:

providing an electrostatic image bearing member for bearing an electrostatic image on the surface thereof and a toner carrying member for carrying a substantially non-magnetic toner on the surface thereof so that the electrostatic image bearing member and the toner carrying member face each other with a gap therebetween at a developing station, causing the toner to be carried on the toner carrying member to form a toner layer in a thickness thinner than said gap and in a packing density of 0.1 to 0.6 g/cm$^3$, and causing the toner to be transferred onto the electrostatic image bearing member at the developing station.

In the developing method of the present invention as described above, it is preferred to apply an alternating and/or direct current bias between the toner carrying member and the electrostatic image bearing member at the developing station, according to necessity.

DETAILED DESCRIPTION OF THE INVENTION

Figure 1:
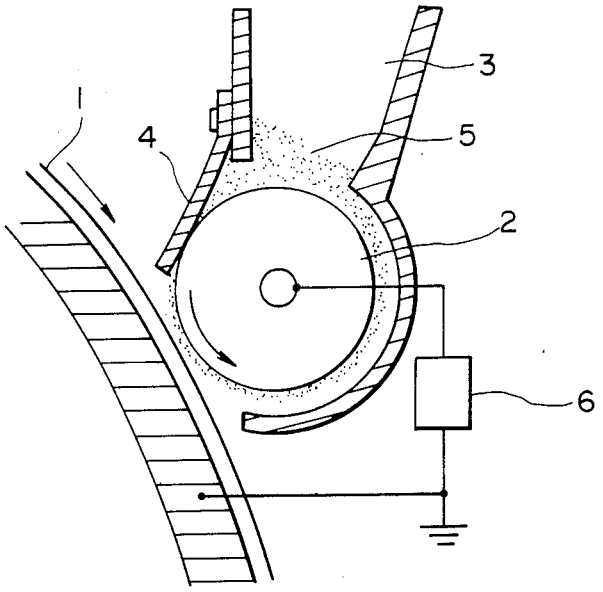
FIGS. 1 through 6 respectively show a schematic partial view in section of an exemplary developing apparatus for practicing the developing method of the present invention, wherein the like parts are expressed by the same or like reference numerals.

We have investigated the developing methods known heretofore using insulating toners which are substantially non-magnetic in various respects. As the result, we have obtained a knowledge that it is essential in this type of developing method to effect a more accurate control of the packing density of the toner on the toner carrying member than in the developing method using magnetic toners. More specifically, too low a packing density leads to a tendency of resulting in poor quality of images which have lost sharpness or are accompanied with a defect such as fog. On the contrary, if the packing density is excessively high, development cannot be conducted effectively to result in defects such as dropping-off of images or decrease in image density.

The present invention has overcome the above difficulties in the type of developing method using a substantially non-magnetic toner, i.e., a non-magnetic or weakly magnetic toner having a saturation magnetization of 10 emu/g or below when measured in an external magnetic field of 5000 Oersted, wherein the toner is carried mainly by a non-magnetic force on a toner carrying member to effect development at the developing station, by regulating the packing density of the toner on the toner carrying member within the range of 0.1 to 0.6 g/cm$^3$, preferably 0.15 to 0.5 g/cm$^3$.

The toner layer having a packing density as explained above has shown good developing performance when formed in a variety of applications as will be explained hereinafter. Further, it has given good images even under various environmental conditions such as high temperature-high humidity and low temperature-low humidity and even after a long term of repetitive image formations.

The binder resin of the toner to be used in the developing method of the invention may be homopolymers of styrene and derivatives thereof such as polystyrene, poly-p-chlorostyrene, polyvinyltoluene, and the like; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylte copolymer, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic acid ester copolymer, and the like; polymethyl methacrylate, polybutyl methacrylate, polyvinyl chloride, polyvinyl acetate, polyethylene, polypropylene, polyesters, polyurethanes, polyamides, epoxy resins, polyvinyl butyral, polyacrylic acid resin, rosin, modified rosins, terpene resin, phenol resins, aliphatic or alicyclic hydrocarbon resins, aromatic petroleum resin, chlorinated paraffin, paraffin wax, etc. These binder resins may be used either singly or as a mixture.

As the colorants to be used in the toner, colorants known in the art such as carbon black, dyes and pigments may be used. Further, positive or negative charge controlling agents known in the art may also be added. Fine powder of a metal oxide such as colloidal silica may further be added, if necessary.

For the purpose of preventing the scattering of the toner and the like, the toner may contain a small amount of magnetic powder. Powder of materials magnetizable when placed in a magnetic field may be used as the magnetic material, including powders of magnetic metals such as iron, cobalt and nickel and alloys or compounds such as magnetite, hematite and ferrite. The content of the toner may preferably be not higher than 15 wt. % or such that the true specific gravity of the toner does not exceed 1.2.

The production method of the toner used in the present invention is not restricted in any way. For example, the toner may be produced through the steps of kneading, crushing and classification, by dispersion into a liquid or gaseous phase, or by a microencapsulation method.

The toner may be mixed with carrier particles such as iron powder, glass beads, nickel powder and ferrite powder, according to necessity and used as a developer for electric latent images.

The present invention will be described in detail by referring to embodiments and actual examples of practice.

FIG. 1 shows an example of a developing apparatus for practicing an embodiment of the developing method of the invention using a substantially non-magnetic insulating toner. In the figure, an electrostatic latent image is formed by the known Carlson process or NP process on a cylindrical electrostatic image bearing member 1. On the other hand, on a toner carrying member 2 is applied an insulating non-magnetic toner 5 in a hopper 3 as a toner supplying means by using a toner application means for applying a toner layer while regulating the thickness thereof. The electrostatic image on the image bearing member 1 is developed with the layer of toner formed on the toner carrying member 2. The toner carrying member 2 is a developing roller comprising a cylinder of stainless steel. The developing roller may be made of aluminum or another metal. The metal roller may be coated with another material such as a resin in order to triboelectrically charge the toner in a more desired polarity and intensity. Further the developing roller can be made of an electroconductive nonmetallic material. At both ends of the toner carrying member 2 are provided unshown spacer rollers made of polyethylene by the medium of the shaft of the carrying member 2 and, by abutting the spacer rollers to the both peripheral ends of the electrostatic image bearing member 1 and fixing the developing apparatus, the gap or clearance between the electrostatic image bearing member 1 and the toner carrying member 2 is set larger than the thickness of the toner layer formed on the toner carrying member 2. The gap is for example 100 to 500 microns and preferably 150 to 300 microns. When the gap is too large, the electrostatic force exerted on the non-magnetic toner applied on the toner carrying member from the electrostatic latent image on the electrostatic image bearing member 1 becomes too weak, whereby image quality is deteriorated and particularly visualization of thin lines by development becomes too difficult. On the contrary, when the gap is too small, the toner applied on the toner carrying member 2 is liable to be compressed to agglomerate with each other. A developing bias source 6 is provided to apply a voltage between the toner carrying member 2 and the electrode disposed on the back side of the electrostatic image bearing member 1. The developing bias voltage is similar to that shown in Japanese Patent Publication No. 32375/1983.

Figure 2:
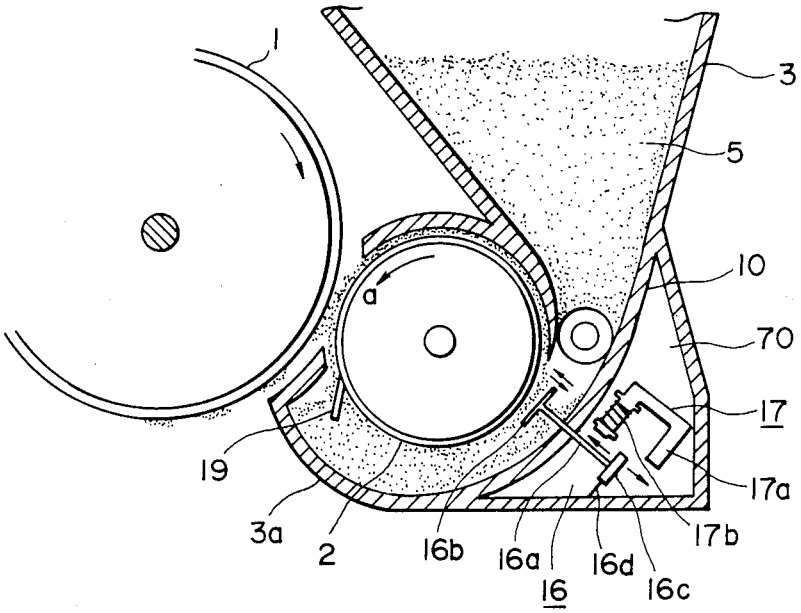

FIG. 2 shows another embodiment. The developing apparatus shown in FIG. 2 comprises an electrostatic image bearing member 1, a toner carrying member 2, a hopper 3, a toner 5, a cleaning blade 9, a toner supplying member 10, a vibrating member 16, vibration generating means 17, a permanent magnet 16*a*, a support spring 16*b*, a core 17*a*, and a winding 17*b*. An alternating current is applied to the winding 17*b* to vibrate the vibrating member 16 at an appropriate amplitude and frequency, whereby a uniformly applied layer of non-magnetic toner is formed on the toner carrying member 2. The toner carrying member 2 is faced to the electrostatic image bearing member 1 with a gap therebetween thicker than the toner layer at the developing station where the toner is caused to jump onto the electrostatic image to effect development. The degree of vibration of the vibrating member 16 is chosen as desired as far as it does not directly touch the toner carrying member 2, whereas it is preferred that the frequency and amplitude are so selected that the thickness of the toner layer will uniformly be 15 to 100 microns. It is also possible to apply an alternating and/or direct developing bias voltage between the toner carrying member 2 and the electrostatic image bearing member 1.

Figure 3:
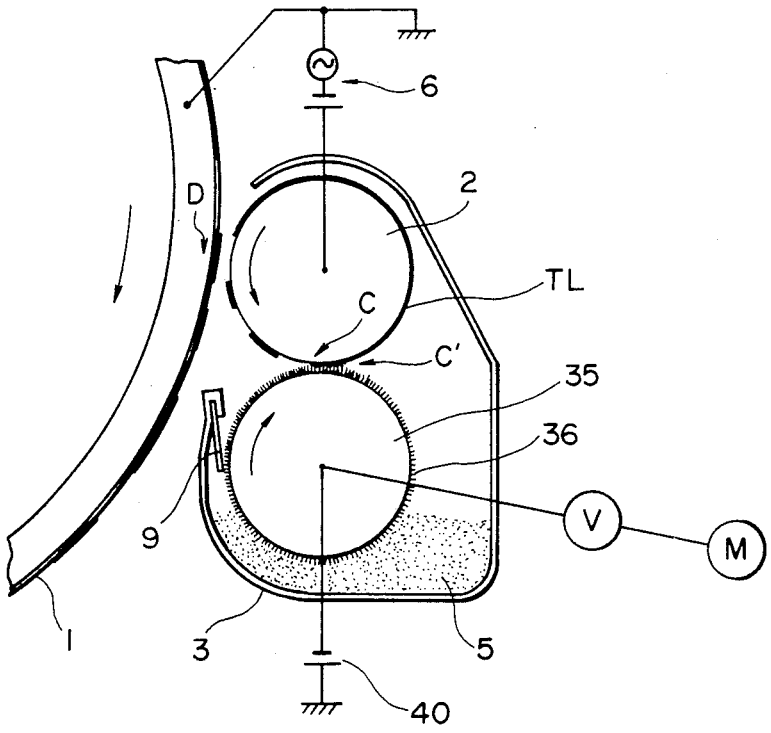

FIG. 3 shows another embodiment. In FIG. 3 is shown a developing apparatus comprising an electrostatic image bearing member 1, a toner carrying member 2, a developing vessel 3 containing a toner 5, a developing bias source 6, a toner cleaning member 9, an application roller 35, a fiber brush affixed to the surface of the roller 35, and a bias source 40 for application. The toner 5 is transferred and uniformly applied onto the toner carrying member 2 by the brush 36 affixed to the rotating application roller 35. A thin layer TL of the toner is then caused to jump onto an electrostatic image on the image bearing member 1 at the developing station D. The gap between the toner carrying member 2 and the application roller 35 is so adjusted to form a uniform toner layer TL in a thickness of the order of 15 to 100 microns. Herein, a bias voltage may be applied from the bias source 40 in order to effect uniform application of the toner. The gap between the electrostatic image bearing member 1 and the toner carrying member 2 is set to be larger than the above-mentioned toner thickness. During the development, a bias voltage may be applied between the image bearing member 1 and the toner carrying member 2 from the bias source 6 for development.

Figure 4:
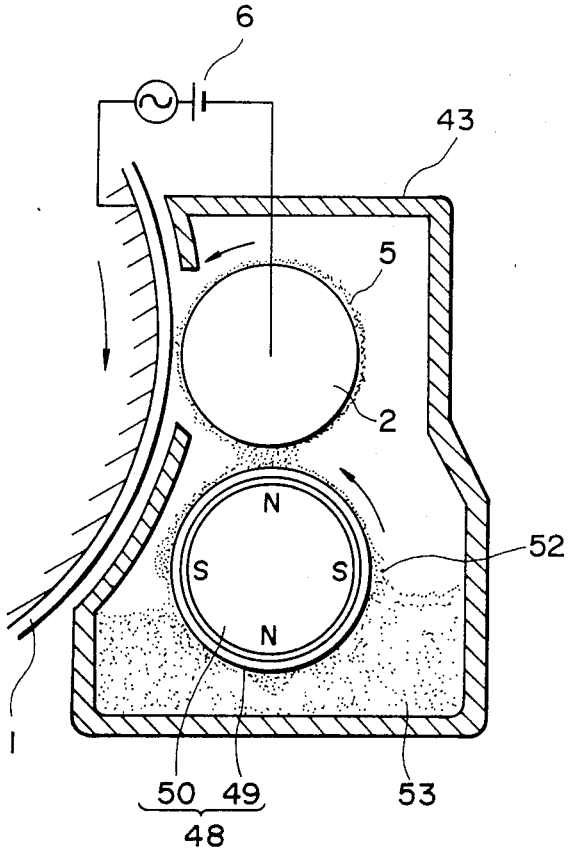

FIG. 4 shows another embodiment. In the figure is shown a developing apparatus comprising an electrostatic image bearing member 1, a toner carrying member 2 for carrying a toner 5, a developing vessel 43, a magnetic roller 48, a non-magnetic sleeve 49 of the magnetic roller 48, a magnet 50, a magnetic brush 52, a one-component toner 53 or a two component developer 53 comprising a mixture of a toner and magnetic particles. Magnetic particles are held by a magnetic force on the non-magnetic sleeve 49 to form a magnetic brush, which is rotated with the rotation of the sleeve 49 to draw up the toner or developer 43 and applying by contact the toner on the toner carrying member 2, whereby a uniform toner layer 5 is formed. At this time, the magnetic particles are held on the magnetic roller 48 by a magnetic force and therefore not transferred onto the toner carrying member 2. The toner applied on the toner carrying member 2 is caused to jump onto the electrostatic image bearing member to effect development. The gap between the magnetic roller 48 and the toner carrying member 2 is adjusted so as to form a toner layer with a thickness of the order of 15 to 100 microns. The gap between the electrostatic image bearing member 1 and the toner carrying memer 2 is set to be larger than the above-mentioned toner thickness, and a bias voltage for development may be applied to the toner carrying member 2.

Figure 5:
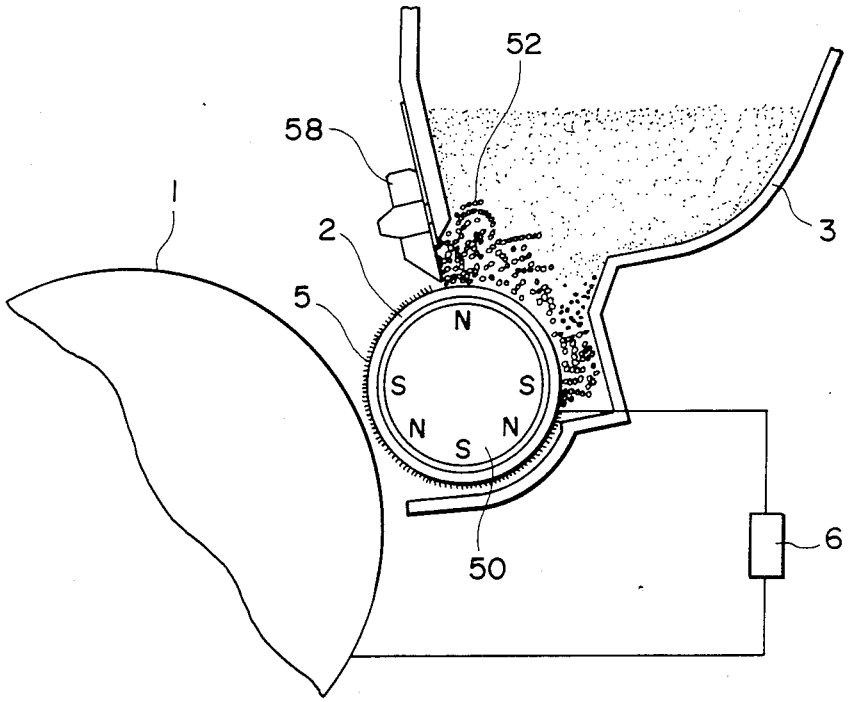

FIG. 5 shows still another embodiment. The developing apparatus shown in the figure comprises an electrostatic image bearing member 1, a toner carrying member 2 for carrying a toner 5, a hopper 3, a bias source for development 6, a fixed magnet 50, a magnetic brush 52 comprising a mixture of magnetic particles and the toner. The magnetic brush 52 formed on the toner carrying member 2 is caused to circulate by rotating the toner carrying member 2, whereby the toner in the hopper 3 is drawn into the magnetic brush and applied to form a uniformly thin layer of the toner. The toner carrying member 2 is faced to the image bearing member 1 with a gap therebetween larger than the toner layer thickness, whereby the toner is caused to jump onto the electrostatic image on the electrostatic image bearing member 1. The electric charge and thickness of the toner layer are controlled by the size of the magnetic brush 52 and the degree of circulation thereof. The gap between the electrostatic image bearing member and the toner carrying member is set larger than the thickness of the toner layer, and a developing bias may be applied by a bias source for development.

Figure 6:
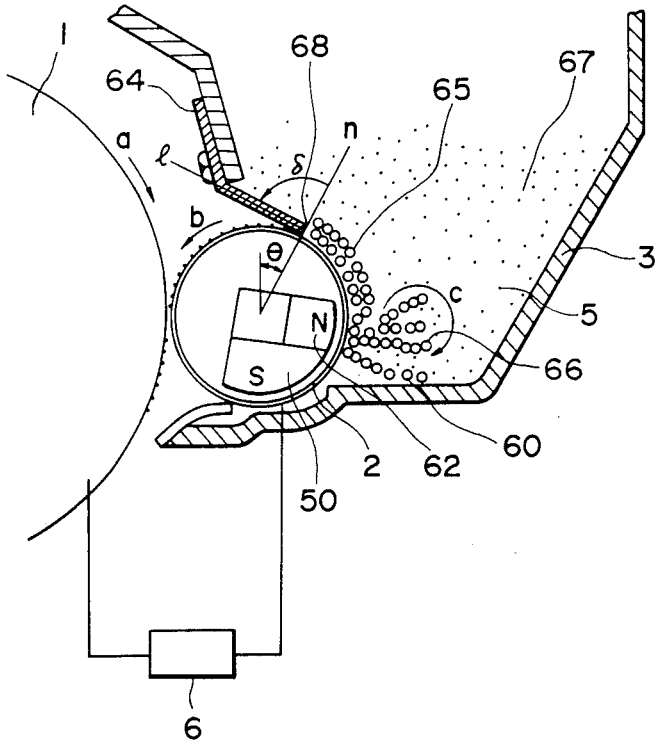

FIG. 6 shows a still further embodiment of the present invention. In FIG. 6, a cylindrical photosensitive member for electrophotography 1 is rotatable in the direction shown by arrow a. Facing the photosensitive member 1 is provided a non-magnetic sleeve 2 as a toner carrying member with a gap therebetween. The sleeve 2 rotates in the direction shown by arrow b along with the movement of the photosensitive member 1. Inside the sleeve 2 is provided a fixed magnet 50 as a magnetic field generating means. A hopper 3 as a developer supplying container accommodates a developer mixture comprising a toner 5 and magnetic particles 60 in combination with the sleeve 2. A magnetic brush is formed of magnetic particles 60 in the neighborhood of the surface of the sleeve 2 corresponding to the magnetic pole 62 of the magnet 60. When the sleeve 2 is rotated in the direction of arrow b, the magnetic brush circulates in the direction of arrow c in the neighborhood of the magnetic pole 62 to form a circulating layer 66 by appropriately selecting the place of arrangement of the magnetic pole 62 and the circulatability and the magnetic characteristics of the magnetic particles 60.

On the other hand, at point 68 downstream of the magnetic pole 62 with respect to the rotational movement of the sleeve is disposed a magnetic blade 64 of a magnetic material as a means for confining magnetic particles with an appropriate gap from the sleeve 2 and with its center line 1 forming an angle with respect to a normal at point 68 against the sleeve 2 slanted in the downstream direction with respect to the movement of the sleeve 2. Magnetic particles 60 are confined at the point 68 on the surface of the sleeve 2 by the balance of gravity, a magnetic force and a confining force due to the presence of the magnetic blade 64 to form a stationary layer 65 within which magnetic particles can be slightly movable but are almost immobile. Thus, a magnetic particle layer comprising the circulating layer 66 and the stationary layer 65 is formed on the sleeve 2. The magnetic particle layer contains toner 5. While the magnetic particles in the stationary layer 65 are confined on the sleeve due to the balance between the above mentioned confining force and the conveying force, the toner is not confined by the magnetic field given by the magnetic pole 62, because it is substantially non-magnetic, and applied to form a uniformly thin layer due to the image force. The thus applied toner is conveyed along with the rotation of the sleeve to face the photosensitive member 1 and is used for developing.

In the circulation layer 66, magnetic particles forming a magnetic brush circulate as shown by arrow c due to gravity, a magnetic force exerted by the magnetic pole, a frictional force and circulatability (viscosity) of the magnetic force. During the circulation, the magnetic brush takes in toner 5 from the developer layer 67 above the magnetic particle layer to return to the lower part of the hopper 3. Thus, the circulation is repeated. The magnetic blade 64 is not directly concerned in the circulation.

As the developing method used herein, one disclosed in Japanese Patent Publication No. 32375/1983 is preferred. Between the electrophotographic photosensitive member 1 and the toner carrying member is applied a voltage from the bias source 6. The bias source may be of an alternating or direct current but should preferably be of a direct current-superposed alternating current. The developer to be used for development is supplied from the circulating layer 66 to the toner carrying member 2 and the shortage of toner in the circulating layer 66 is compensated by the supply of a toner from the developer layer 67 due to the above mentioned circulation.

The present invention will further be explained by referring to actual examples of practice. In the following description, "parts" used for referring to quantities are all by weight.

EXAMPLE 1

A mixture comprising 100 parts of styrenebutyl methacrylate copolymer, 10 parts of a phthalocyanine pigment and 2 parts of nigrosine was well blended in a blender and kneaded on a twin roll heated to 150° C. The kneaded product was left to cool, coarsely crushed by a cutter mill, pulverized by means of a micropulverizer with a jet air stream and further subjected to classification by use of a wind force classifier to obtain colored fine powder (toner) with a volume-average particle size of 11 microns. The true specific gravity of the toner was 1.07.

On the other hand, a mixture comprising 100 parts of zinc oxide, 20 parts of styrene-butadiene copolymer, 40 parts of n-butyl methacrylate, 120 parts of toluene and 4 parts of 1% solution of Rose Bengal in methanol was mixed for dispersion on a ball mill for 6 hours. The mixture was then applied with a wire bar onto an aluminum plate of 0.05 mm in thickness so as to give a dry thickness of 40 microns and heated with warm air to evaporate off the solvent and obtain a photosensitive member of zinc oxide-binder type, which was then formed into a drum. The photosensitive member was subjected to corona discharge at −6 kV to be uniformly charged and then irradiated with an original image light, whereby an electrostatic latent image was formed.

The above mentioned toner was charged in a developing apparatus as shown in FIG. 1 and carried on the toner carrying member to form a toner layer. The toner layer was found to have a coating rate of 0.83 mg/cm$^2$, a thickness of 35 microns and a packing density of 0.24 g/cm$^3$. Here, the coating rate was obtained by collecting by suction a predetermined area of the toner on the toner carrying member, and the thickness was measured by using a laser beam. These measurement methods were also used in the other examples.

By using the developing apparatus thus arranged, the above-mentioned electrostatic latent image was developed. In this case, the toner carrying member 2 was a cylindrical sleeve of stainless steel having an outer diameter of 50 mm, the gap between the photosensitive drum and the sleeve 2 was set at 0.25 mm and a bias of an alternating current voltage of 1000 V at 400 Hz superposed with a direct current voltage of −150 V was applied to the sleeve.

Then, the developed toner image was transferred onto a paper while irradiating a direct current corona at −7 kV and fixed thereon to obtain a copied image. The fixing was conducted by a fixer of a commercially available plain paper copier (Trade name: NP-5000, mfd. by Canon K.K.).

The thus obtained copied image was a good image of a sufficiently high density as high as 1.28, without fog at all, free from scattering of toner around and having a high resolution. The copying was continuously repeated with the above toner for examination of the durability, copied images even after copying of 10,000 sheets were not inferior at all to the images obtained at the initial stage.

When the environmental conditions were changed to 35° C. and 85% R.H., the image density was 1.21, which was a value substantially unchanged from that under normal temperature and normal humidity conditions, and clear blue images could be obtained without fog and scattering of the toner, indicating substantially the same performances up to 10000 sheets of copying. Then, when transferred images were obtained at a low temperature and a low humidity of 10° C. and 10%, the image densities were found to be high up to 1.33, and the solid image portions could be developed and transferred very smoothly to give excellent images without scattering or drop-off of the toner. When successive copying was conducted under these environmental conditions, both continuously and intermittently, the density fluctuation was within ±0.2 up to 10,000 sheets of copying, thus showing satisfactory results in practical applications.

COMPARATIVE EXAMPLE 1

The procedure of Example 1 was repeated except that the pressure for pushing the toner application means 4 onto the toner carrying member 2 was increased, whereby a toner layer was formed on the toner carrying member with a coating rate of 0.81 mg/cm$^2$, a thickness of 11 microns and a packing density of 0.74 mg/cm$^3$. In the developed images, partial drop-off of image was observed.

COMPARATIVE EXAMPLE 2

The procedure of Example 1 was repeated except that the pressure for pushing the toner application means 4 onto the toner carrying member 2 was decreased, whereby a toner layer was formed on the toner carrying member with a coating rate of 0.98 mg/cm$^2$, a thickness of 107 microns and a packing density of 0.092 g/cm$^3$. In the developed images, serious fog occurred.

EXAMPLE 2

A developing operation was carried out by using the toner of Example 1 and an apparatus shown in FIG. 2. The vibrating member 16 was vibrated at a frequency of 50 Hz and an amplitude of 0.2 mm, and the toner carrying member 2 was rotated at a peripheral speed of 120 mm/sec., whereby a uniformly applied layer of toner was formed on the toner carrying member with a coating rate of 0.65 mg/cm$^2$, a thickness of 25 microns and a packing density of 0.26 g/cm$^3$. The toner carrying member 2 was faced to the electrostatic image bearing member 1 bearing a latent image having a maximum surface potential of −600 V thereon with a gap of about 300 microns, and an alternating bias of a frequency of 100 Hz to several kHz, a minus peak voltage of −660 to −1200 V and a plus peak voltage of +400 to +800 V was applied to the toner carrying member 2, whereby developing was conducted to result in similarly good results.

EXAMPLE 3

A toner having a true density of 1.08 and a volume-average particle size of 12 microns was prepared from 100 parts of styrene-acrylic-maleic anhydride copolymer, 10 parts of a Rhodamine dye and 2 parts of di-tertiarybutylsalicylic acid chromium complex. The toner was charged in an apparatus shown in FIG. 3, wherein the gap between the toner carrying member 2 and the application roller 35 was set at about 2 mm, the length of the brush was about 3 mm, and the gap between the carrying member and the electrostatic image bearing member of a CdS-NP photo-sensitive material was set at 300 microns, whereby a toner layer was formed on the toner carrying member 2 with a coating rate of 0.73 mg/cm$^2$, a toner thickness of 23 microns and a packing density of 0.32 g/cm$^2$.

Developing was conducted by applying a bias voltage with peak values of +700 V and −200 V given by superposing an alternating current component of a frequency of 200 Hz and peak voltages of ±450 V and a direct current component of 250 V, and transferring of the resultant developed image was conducted by applying a transfer voltage of +7 kV, whereby good results were similarly obtained.

EXAMPLE 4

A mixture of 10 g of the toner of Example 3 and 50 g of ferrite carrier was charged in an apparatus as shown in FIG. 4 wherein the gap between the toner carrying member 2 and the magnetic roller 48 was set at about 2 mm, and the maximum thickness of the magnetic brush was set at about 3 mm. Thus, a uniform toner layer was formed with a coating rate of 0.92 mg/cm$^2$, a thickness of 20 microns and a packing density of 0.46 g/cm$^3$. By using the toner layer, developing and transfer were conducted similarly as in Example 3, whereby good results were obtained similarly.

EXAMPLE 5

A mixture of 20 g of the toner of Example 1 and 60 g of iron powder carrier prepared in advance was charged in an apparatus as shown in FIG. 5 wherein the gap between the regulating blade 58 and the toner carrying member 2 was set at about 250 microns, whereby a uniform toner layer was obtained with a coating rate of 0.54 mg/cm$^2$, a thickness of 22 microns and a packing density of 0.25 g/cm$^3$. Developing and transfer were conducted similarly as in Example 1, whereby good results were obtained similarly.

EXAMPLE 6

A mixture of 20 g of the toner of Example 1 and 50 g of ferrite carrier prepared in advance was charged in an apparatus shown in FIG. 6. In the apparatus, the gap between the tip of the magnetic blade 64 and the toner carrying member 2 was set at about 300 microns, whereby a thin uniform toner layer was formed on the toner carrying member 2 with a coating rate of 0.48 mg/cm$^2$, a thickness of 22 microns and a packing density of 0.22 g/cm$^3$. Using the toner layer, and the apparatus developing was conducted similarly as in Example 1, whereby good results were obtained similarly.

EXAMPLE 7

A mixture of 100 parts of styrene-2-ethylhexyl acrylate-diethylaminoethyl methacrylate copolymer (copolymerization ratio=80:15:5) and 70 parts of $\alpha$-$Fe_2O_3$ particles (average particle size of 0.5 micron, non-magnetic) was melt-kneaded, crushed after cooling and classified to obtain fine powder having a volume-average particle size of 13 microns. To 100 parts of this fine powder was externally added 0.5 part of colloidal silica to obtain a toner having a true specific gravity of 1.51.

This toner in an amount of 20 g was mixed with 50 g of irregular shape iron powder having particle sizes between 150 mesh and 250 mesh and then charged and used in the apparatus used in Example 6, whereby a uniform toner layer was formed with a coating rate of 1.15 mg/cm$^2$, a thickness of 23 microns and a packing density of 0.50 g/cm$^3$.

By using the toner layer and the apparatus, developing test was conducted as in Example 1, whereby good images were obtained in a bright sepia color.

What is claimed is:

1. A developing method comprising:

providing an electrostatic image bearing member for bearing an electrostatic image on the surface thereof and a metal roller as a toner carrying member for carrying a substantially non-magnetic toner on the surface thereof so that the electrostatic image bearing member and the bone carrying member face each other with a gap of about 100 to 500 microns therebetween at a developing station, causing the toner to be carried on the metal roller to form a toner layer having a thickness of about 15 to less than 100 microns and less than said gap and in a packing density of 0.1 to 0.6 g/cm$^3$, and causing the toner to be transferred across the gap onto the electrostatic image bearing member at the developing station.

2. The developing method according to claim 1, wherein the substantially non-magnetic toner has a saturation magnetization of 0–10 emu/g when measured in an external magnetic field of 5000 Oersted.

3. The developing method according to claim 1, wherein the substantially non-magnetic toner has a true density of 1.2 or below.

4. The developing method according to claim 1, wherein the toner layer carried on the toner carrying member has a packing density of 0.15 to 0.5 g/cm$^3$.

5. The developing method according to claim 1, wherein the gap is about 150 to 300 microns.

6. The developing method according to claim 1, wherein the toner carrying member comprises a cylinder of stainless steel.

7. The developing method according to claim 1, wherein the toner carrying member comprises a cylinder of aluminum.

8. The developing method according to claim 1, wherein the electrostatic image is developed by the toner while an alternating current bias and/or direct current bias is applied between the toner carrying member and the electrostatic image bearing member at the developing station.

* * * * *

UNITED STATES PATENT AND TRADEMARK OFFICE

CERTIFICATE OF CORRECTION

PATENT NO. : 4,666,814

DATED : May 19, 1987

INVENTOR(S) : KOSHI SUEMATSU, ET AL.

It is certified that error appears in the above-identified patent and that said Letters Patent is hereby corrected as shown below:

COLUMN 4

Line 1, "methacrylte" should read --methacrylate--.

COLUMN 7

Line 13, "1" should read -- ℓ --.
Line 63, "styrenebutyl" should read --styrene-butyl--.

COLUMN 8

Line 50, "durability, copied" should read --durability. Copied--.

COLUMN 9

Line 55, "photo-sensitive" should read --photosensitive--.

UNITED STATES PATENT AND TRADEMARK OFFICE

CERTIFICATE OF CORRECTION

PATENT NO. : 4,666,814

DATED : May 19, 1987

INVENTOR(S) : KOSHI SUEMATSU, ET AL.

It is certified that error appears in the above-identified patent and that said Letters Patent is hereby corrected as shown below:

COLUMN 10

Line 68, "bone" should read --toner--.

Signed and Sealed this

Fifth Day of January, 1988

*Attest:*

DONALD J. QUIGG

*Attesting Officer*

*Commissioner of Patents and Trademarks*